United States Patent [19]

Koenig

[11] 4,089,471

[45] May 16, 1978

[54] PULSATING SHOWER HEADS

[75] Inventor: Shulamith S. Koenig, Tel Aviv, Israel

[73] Assignee: Incontrol Industries Ltd., Tel Aviv, Israel

[21] Appl. No.: 713,615

[22] Filed: Aug. 11, 1976

[30] Foreign Application Priority Data

Jan. 29, 1976 Israel ..... 48929
Apr. 2, 1976 Israel ..... 49338

[51] Int. Cl.[2] ..... B05B 3/06

[52] U.S. Cl. ..... 239/381; 239/101; 239/447; 239/460; 239/562

[58] Field of Search ..... 239/102, 380, 381, 390–392, 239/395, 396, 436–438, 443, 444, 446–449, 451, 456, 460, 562, 101; 401/28; 128/62 A, 66

[56] References Cited

U.S. PATENT DOCUMENTS

| | | | |
|---|---|---|---|
| 3,004,719 | 10/1961 | Pouppirt, Jr. | 239/381 |
| 3,403,860 | 10/1968 | Shames et al. | 239/460 |
| 3,736,923 | 6/1973 | Parkison | 128/66 |
| 3,929,287 | 12/1975 | Gliver et al. | 239/449 X |
| 3,967,783 | 7/1976 | Halsted et al. | 239/102 |

*Primary Examiner*—John J. Love
*Assistant Examiner*—Andres Kashnikow
*Attorney, Agent, or Firm*—Benjamin J. Barish

[57] ABSTRACT

A pulsating shower head comprises a liquid chamber containing a spray block having an annular channel in which are disposed movable members in the form of rotatable balls and slidable segments driven by the force of the liquid to successively cover and uncover outlet openings formed in the annular channel to produce a pulsating effect on the liquid jets exiting from the spray block. The described shower head further includes additional outlet openings for producing non-pulsating liquid jets, and a manipulatable member for selectively connecting either the annular channel outlet openings to the liquid chamber in order to produce the pulsating liquid jets or to connect the additional outlet openings to the liquid chamber to produce non-pulsating liquid jets.

11 Claims, 5 Drawing Figures

FIG.3
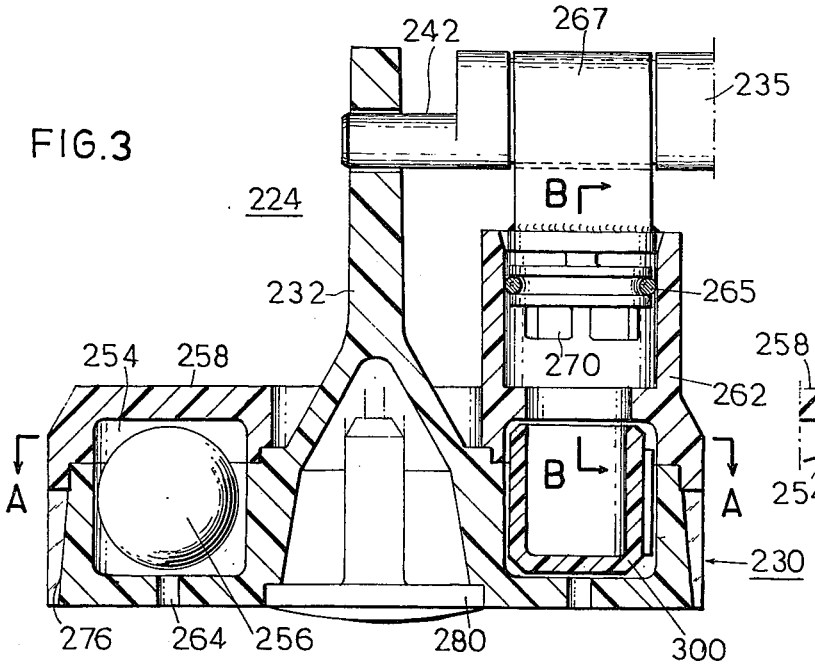
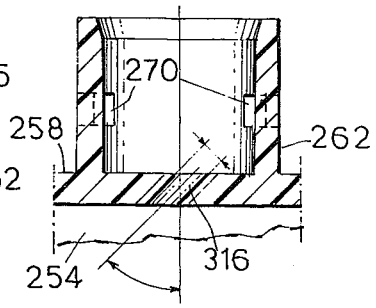
FIG.3b
FIG.3a
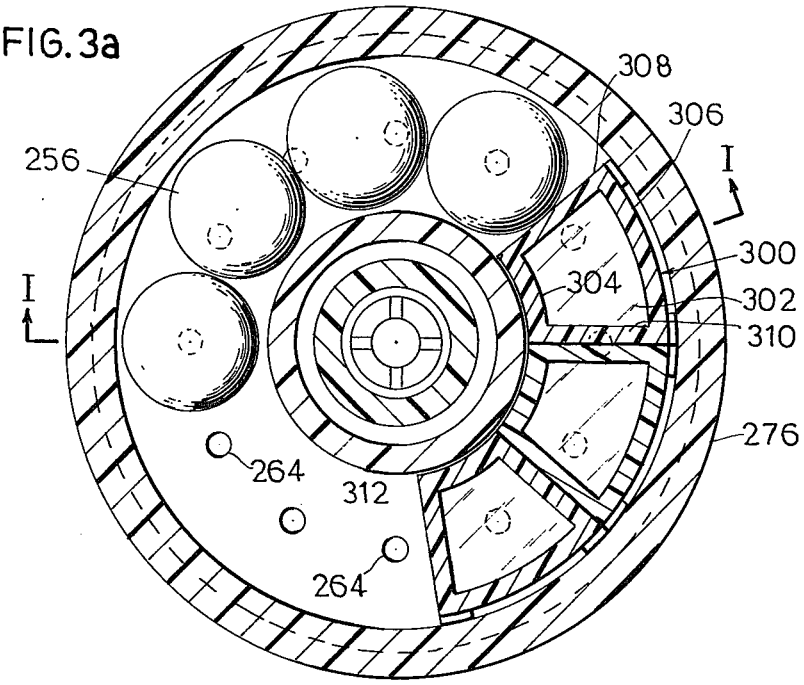

PULSATING SHOWER HEADS

BACKGROUND OF THE INVENTION

The present invention relates to shower heads, and particularly to a pulsating type of shower head wherein a pulsating effect is produced on the liquid jets exiting from the head.

A number of pulsating shower heads are known. These typically include fuild oscillators in the form of valves which may be mechanically actuated to periodically interrupt the flow of liquid. As a rule, the known devices are of complicated construction and are therefore expensive to produce. In addition, some of the known devices suffer from "water-hammer" effects arising by the abrupt interruption of the liquid flow and thereby causing strong pressure waves to be produced and propagated along the liquid system.

SUMMARY OF THE PRESENT INVENTION

An object of the present invention is to provide a pulsating shower head having advantages in the above respects.

According to the present invention, there is provided a pulsating shower head comprising a housing formed with an internal liquid chamber, a spray block having an annular channel communicating with the liquid chamber and formed with outlet openings extending through the spray block to produce a plurality of liquid jets exiting from the housing, and a plurality of movable members, including slidable segments and/or rotatable balls, disposable in the annular channel and driven by the force of the liquid to successively cover and uncover the outlet openings and thereby to produce a pulsating effect on the liquid jets exiting from the housing.

According to another feature of the invention, the shower head includes additional outlet openings to produce non-pulsating liquid jets, and a manipulatable member for selectively connecting the annular channel outlet openings or the additional outlet openings to the liquid chamber.

Further, an improved pulsating effect can be produced if the balls movable in the annular channel by the force of the liquid flowing therethrough include non-rollable members.

Further features of the invention will be apparent from the description below.

BRIEF DESCRIPTION OF THE DRAWINGS

The invention is herein described, by way of example only, with reference to the accompanying drawings, wherein:

FIG. 3 is a longitudinal sectional view illustrating another spray block constructed in accordance with the invention for use in the pulsating shower head of FIGS. 1 and 2;

FIG. 3*a* is a transverse sectional view along lines A—A of FIG. 3; and

FIG. 3*b* is a sectional view along lines B—B of FIG. 3.

DESCRIPTION OF THE PREFERRED EMBODIMENTS

Figure 1:
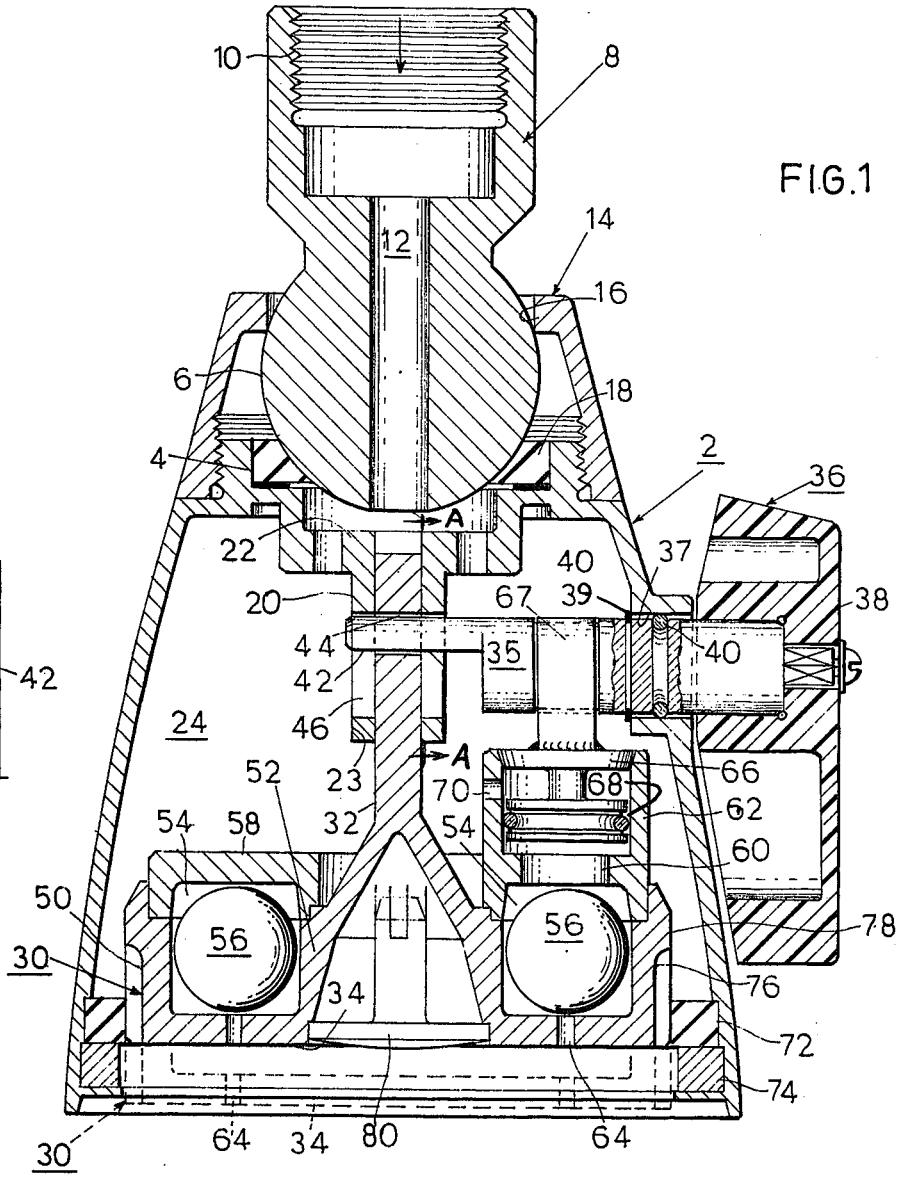
FIG. 1 is a longitudinal sectional view of one form of pulsating shower head constructed in accordance with the invention, the parts being shown in the pulsating-jet-disabling position in full lines, and in the pulsating-jet-enabling position in broken lines.
Figure 1A:
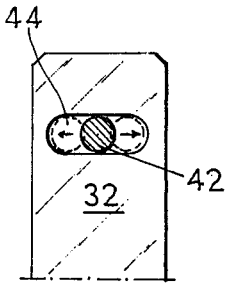
FIG. 1*a* is a sectional view along lines A—A in FIG. 1.

The pulsating shower head illustrated in FIG. 1 comprises a housing, generally designated 2, of frusto-conical shape pivotably mounted at its upper end 4 to a ball joint 6 carried by a fitting 8 attachable to the water supply pipe by means of internal screw threads 10. Ball joint 6 is formed with an axial bore 12 for the liquid, and is attached to the shower head housing 2 by means of a collar 14 threaded at one end to the housing, and formed with a reduced-diameter neck 16 at the opposite end for receiving the ball 6. The upper end 4 of housing 2 includes an annular gasket 18 sealingly engagable with the outer surface of ball 6.

The upper end of housing 2 is formed with a re-entrant sleeve 20 of rectangular section open at its upper end 22 to communicate with bore 12 of ball joint 6. The lower end 23 of sleeve 20 is also open and leads into an internal chamber 24 formed within housing 2.

Disposed within internal chamber 24 is a spray block, generally designated 30, including a vertical supporting leg 32 passing within sleeve 20, and a horizontal apertured plate 34. Spray block 30 is movable to a raised position as illustrated in full lines in FIG. 1, by means of a manipulatable member, generally designated 36, including a rotatable knob 38 external to housing 2 and fixed to a shaft 35 rotatable within an opening 37 in the housing wall. Shaft 35 is secured within opening 37 by means of a retainer ring 39. A sealing ring 40 is provided within the opening to prevent leakage from internal chamber 24.

The inner end 42 of shaft 35 is of reduced diameter so as to provide an eccentric support for vertical leg 32 of spray block 30. Eccentric end 42 of shaft 35 passes through an opening 44 in leg 32 of the spray block and through enlarged aligned openings 46 in sleeve 20. It will thus be seen that when knob 38 is rotated in one direction it raises spray block 30 as shown in full lines in FIG. 1, and when rotated in the opposite direction, it lowers the spray block as shown in broken lines in FIG. 1.

Spray block 30 is formed with a pair of coaxial annular walls 50, 52, defining an annular channel 54. The two walls 50, 52 are spaced from each other a distance equal to the diameter of one or more balls 56 disposed within annular channel 54. Channel 54 is closed at its upper end by an annular wall 58, except for an opening 60 formed within a sleeve 62 fixed to the annular wall to permit the inflow of the liquid into the annular channel 54. The lower end of annular channel 54 is closed by the horizontal plate 34 of the spray block, and is formed with an annular array of outlet openings 64, extending substantially parallel to each other through wall 34 of the spray block to produce a plurality of substantially parallel liquid jets exiting from housing 2 of the shower head. Openings 64 are successively covered and uncovered by the balls 56 as they are driven around the channel by the force of the liquid entering same through sleeve 62, to produce a pulsating effect on the liquid jets exiting through openings 64.

Sleeve 62 cooperates with a stem 66 loosely carried by a strap 67 on shaft 35 of rotatable knob 38. The lower end of stem 66 carries a disc having an annular sealing ring 68 engagable with the inner surface of sleeve 62. The latter sleeve is formed with one or more holes 70 which are above sealing ring 68 in the upper position of the spray block as shown in FIG. 1, and are below the sealing ring in the lower position of the spray block as shown in broken lines in FIG. 1.

Another sealing ring 72 is disposed at the lower end of housing 2 and is secured by a retainer ring 74. The outer surface of annular wall 50 of the spray block is formed with a plurality of axially extending, circumferentially spaced, recesses 76 which terminate in a continuous annular rim 78. The arrangement is such that in the upper position of spray block 30, recesses 76 form outlet openings communicating with water chamber 24, but in the lower (broken-line) position of the spray block, continuous rim 78 seats against seal 72 interrupting this communication.

Figure 2:
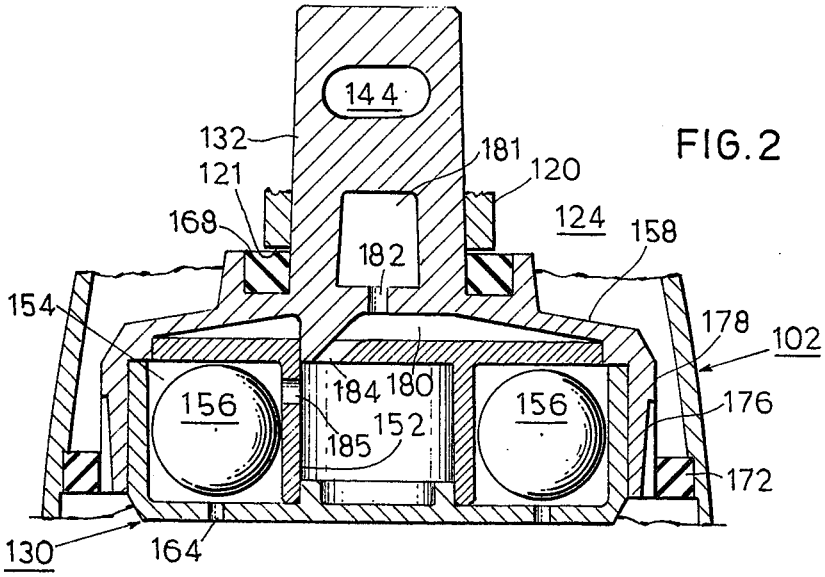
FIG. 2 is a longitudinal sectional view illustrating a variation in the pulsating shower head of FIG. 1.

The shower head illustrated in FIG. 1 and 2 is used in the following manner:

In the raised position of the spray block 30 illustrated in full lines in FIG. 1, its continuous rim 78 is spaced above seal 72 on the inner wall of housing 2. Accordingly, communication is established between recesses 76 and the internal water chamber 24, and therefore the water exits from the shower head in the form of continuous water jets from recesses 76. No water, however, exits from openings 64 in annular channel 54 since, in the illustrated upper position of the shower block 32, openings 70 in sleeve 62 carried by the shower block are above sealing ring 68 carried by stem 66, and therefore the sealing ring interrupts the communication between the water chamber 24 and opening 60 leading into the annular channel 54.

Thus, in the raised condition of the shower block 30 as illustrated in full lines in FIG. 1, the water exits from the shower in the form of a continuous spray via recesses 76, whereas the pulsating spray via openings 64 is disabled by seal 68 interrupting the communication of annular channel 54 with the water chamber 24.

Now, when it is desired to produce the pulsating spray, knob 38 is rotated to lower spray block 30 in view of its eccentric mounting to shaft 35 fixed to the knob. In this lowered condition of the spray block, its continuous rim 78 seats against sealing ring 72, thereby interrupting the communication between recesses 76 and the water chamber 24, so that the water will not exit (in the form of a continuous spray) via these recesses. In addition, sleeve 62 carried by the spray block is lowered so that its openings 70 are now below sealing ring 68 on stem 66, thereby permitting the water in chamber 24 to flow through these openings into inlet 60 of the annular channel 54. This flow of the water rotates balls 56 around the annular channel to successively cover and uncover openings 64, thereby causing the water to exit from these openings in the form of pulsating jets.

FIG. 2 illustrates a variation in the structure of the shower head that may be used. In the variation of FIG. 2, the shower block, generally designated 130, includes the vertical leg 132 and the annular channel 154, corresponding to leg 32 and channel 54 in FIG. 1. In FIG. 2, however, the interruption of the flow of water from the water chamber 124 into annular channel 154 is effected, not by the sleeve 62 and stem 66 arrangement illustrated in FIG. 1, but rather by an annular seal 168 carried on the upper face of the horizontal wall 158 of the spray block 130, which seal cooperates with the open end 121 of the rectangular sleeve 120 (corresponding to sleeve 20 in FIGS. 1 and 2) of the shower head housing 102. The outer periphery of the shower block is also formed with the axial recesses 176 terminating in the continuous rim 178 (corresponding to recesses 76 and rim 78 in FIG. 1) cooperable with a seal 172 carried by the housing. Spray block 130 further includes a passageway 180 leading from an opening 181 in its vertical leg via an opening 182 through the center of the top wall 158 of the spray block 130 to one or more openings 185 formed in the inner annular wall 152 of the annular channel 154. As in the embodiment of FIG. 1, annular channel 154 includes one or more balls 156 adapted to be driven by the water entering the channel to successively cover and uncover the outlet openings 164.

Thus, in the embodiment of FIG. 2, when the spray block 130 is moved to its raised position, its sealing ring 168 abuts against the end 121 of sleeve 120, thereby interrupting the flow of water from chamber 124 via openings 181, 182, 184 and 185, into the interior of annular chamber 154; in this position, rim 178 is spaced from seal 172 permitting the water to flow from the water chamber 124 in the form of continuous jets through recesses 176. However, when the spray block 130 is moved to its lower position, rim 178 seats against seal 172 interrupting the water flow through recesses 176, and seal 168 moves away from the lower tip 121 of sleeve 120 thereby permitting the water to flow through the path including openings 181, 182 passageway 180, and openings 184 and 185 into annular channel 154 to rotate balls 156 and thereby to produce the pulsating jets via openings 164.

FIG. 3 illustrates another form of spray block which may be used. The spray block, generally designated 230, is closed at its center by a cap 280 and is suspended by its vertical leg 232 from an eccentric end 242 of a shaft 235 rotatable by a knob externally of the shower head housing (not shown) in order to raise or lower the spray block with respect to the housing, as described above with respect to FIG. 1. Thus, when shaft 235 is rotated in one direction, it raises the spray block 230 to establish communication between the internal water chamber 224 and the peripheral recesses 276 so that the water exits from the shower head in the form of continuous water jets from recesses 276; and when shaft 235 is rotated in the opposite direction, it lowers the spray block (to the position illustrated in FIG. 3) wherein the above communication between chamber 224 and recesses 276 is interrupted, and instead, communication is established between chamber 224 and annular channel 254 via openings 270 formed in a sleeve 262 carried by the spray block. As described with respect to FIG. 1, in the lower (FIG. 3) position of the spray block, openings 270 are uncovered by sealing ring 265 of stem 266 suspended from shaft 235 by a strap 267, to permit the water to flow from chamber 224 through openings 270 into the annular channel 254.

Thus, as described above, the water entering the annular channel 254 drives the rollable balls 256 through the annular chamber to successively cover and uncover the annular array of outlet openings 264 extending through the bottom wall of the spray block and thereby to produce pulsating jets from the outlet openings 264.

The modification of FIG. 3 includes non-rollable members within annular channel 254 in the form of slidable segments having a bottom wall face conforming to the face of the annular channel 254 through which the outlet openings 264 are formed. This arrangement has been found to substantially improve the pulsating effect produced.

Thus, as shown in FIG. 3, annular chamber 254 includes a plurality of slidable segments 300 movable in the annular chamber 254 with the balls 256 both being driven by the force of the water flowing through the chamber. Each of the slidable segments 300 has a relatively flat surface 302 successively covering and uncovering the outlet openings 264. The flat surface 302 of each of the slidable segment 300 is defined by a substantially flat bottom wall, which wall is perpendicularly joined to a plurality of upstanding walls. Two of the upstanding walls, namely walls 304 and 306, are side walls facing each other and have a curvature conforming to the annular channel 254; whereas the remaining two walls 308, 310, are end walls facing each other, and extend radially with respect to the center of curvature of the annular channel. Preferably, the top of each of the slidable segments 300 is open as shown in FIG. 3.

In the preferred embodiment of the invention illustrated in the drawings, there are twelve outlet openings 264, four rollable balls 256, and three slidable segments 300.

As shown particularly in FIGS. 3 and 3*b*, the annular channel 254 includes a wall 258 closing its upper end. The annular channel communicates with the internal liquid chamber 224 via an opening 316 formed through wall 258 within sleeve 262, opening 316 being formed at an acute angle, preferably about 45°, so as to produce a propelling force by the water on the balls 256 and on the non-rollable members 300.

It has been found that the described construction, including both the rollable balls 256 and the slidable segments 300, results in an improved pulsating effect, in that it sharpens the turn-ons and the turn-offs of the jet pulsations, and also slows down the frequency of their occurrence, when compared to the specific construction illustrated in FIG. 1.

Many variations, modifications and other applications of the described embodiment will be apparent.

What is claimed is:

1. A pulsating shower head, comprising: a housing formed with an internal liquid chamber and with a liquid inlet communicating therewith; a spray block having an annular channel communicating with said liquid chamber which annular channel includes a bottom wall formed with an array of outlet openings to produce a plurality of liquid jets exiting from the housing; and at least one slidable segment disposed in said annular channel, said slidable segment including a bottom wall having a bottom face conforming to the face of the bottom wall of the annular channel, a plurality of upstanding side and end walls, and an open top, said slidable segment being drivable in said annular channel by the force of the liquid flowing therethrough to successively cover and uncover said outlet openings and thereby to produce a pulsating effect on said liquid jets exiting from the housing.

2. A shower head according to claim 1, wherein the shower head includes additional outlet openings for producing non-pulsating liquid jets, and a manipulatable member for selectively connecting said annular channel outlet openings or said additional outlet openings to said liquid chamber.

3. A shower head according to claim 2, wherein said manipulatable member comprises a movable member effective to move the spray block to a first position to establish communication between the annular channel outlet openings and the liquid chamber, or to move the spray block to a second position to establish communication between the additional outlet openings and the liquid chamber, said movable member being a rotatable knob, and the spray block being mounted eccentrically on a shaft rotated by the knob to raise or lower the spray block.

4. A shower head according to claim 3, wherein the inner wall of the housing includes a seal, and wherein said additional outlet openings are defined by axial grooves formed in the outer circumference of the spray block which grooves are brought into communication with the fluid chamber in the raised position of the spray block but are sealed therefrom by said housing seal in the lowered position of the spray block.

5. A shower head according to claim 4, further including a second seal effective in the lowered position of the spray block to effect communication between the annular channel outlet opening and the fluid chamber, and in the raised position of the spray block to interrupt said communication between the annular channel outlet openings and the fluid chamber.

6. A shower head according to claim 5, wherein said second seal is carried by a stem mounted to the housing and is cooperable with a sleeve carried by the spray block, the interior of the sleeve leading to the interior of the annular channel, said sleeve being formed with a radial opening which is disposed on one side of said second seal to effect communication between the annular channel and the liquid chamber in the lowered position of the spray block, and is disposed on the opposite side of said second seal to interrupt said communication in the raised position of the spray block.

7. A shower head according to claim 6, wherein said stem is loosely supported on a shaft fixed to the rotatable knob.

8. A shower head according to claim 5, wherein said second seal is carried by the upper face of the spary block.

9. A shower head according to claim 1, wherein there are a plurality of slidable segments, and said channel further includes a plurality of balls rollable therein, said channel being defined by a pair of coaxial annular walls spaced from each other a distance substantially equal to the diameter of the balls.

10. A pulsating shower head, comprising: a housing formed with an internal liquid chamber and with a liquid inlet communicating therewith; a spray block having an annular channel communicating with the said liquid chamber and formed with an annular array of outlet openings extending through the spray block; at least one ball rollable in said annular channel by the force of the liquid flowing therethrough to successively cover and uncover said outlet openings; and at least one slidable segment movable in said annular channel and having a relatively flat surface successively covering and uncovering said outlet openings to produce pulsating liquid jets exiting from said outlet openings, said slidable segment including a substantially flat bottom wall successively covering and uncovering said outlet openings, an open top, and a plurality of upstanding walls perpendicularly joined to the bottom wall, two of said upstanding walls facing each other and having a curvature conforming to that of the annular channel, the remaining two of said upstanding walls facing each other and extending radially with respect to the center of curvature of said annular channel.

11. A shower head according to claim 10, wherein said annular channel of the spray block includes a plurality of said slidable segments and a plurality of said rollable balls.

* * * * *